US006173660B1

(12) United States Patent
Emmert

(10) Patent No.: US 6,173,660 B1
(45) Date of Patent: Jan. 16, 2001

(54) BENCH FOLDING LEG AND BRACE STRUCTURE

(75) Inventor: Raymond L. Emmert, Oklahoma City, OK (US)

(73) Assignee: Emmert Second Limited Partnership, Oklahoma City, OK (US)

( * ) Notice: Under 35 U.S.C. 154(b), the term of this patent shall be extended for 0 days.

(21) Appl. No.: 09/347,631

(22) Filed: Jul. 2, 1999

(51) Int. Cl.[7] ..... A47B 13/08
(52) U.S. Cl. ..... 108/90; 108/116
(58) Field of Search ..... 108/132, 129, 108/115, 130, 90, 116, 27; 248/188.6

(56) References Cited

U.S. PATENT DOCUMENTS

| | | | | |
|---|---|---|---|---|
| 3,469,870 | | 9/1969 | Barkus . | |
| 3,724,885 | | 4/1973 | Becker . | |
| 3,777,675 | * | 12/1973 | Hanusiak | 108/132 |
| 4,186,784 | * | 2/1980 | Stone | 108/90 X |
| 4,191,111 | * | 3/1980 | Emmert | 108/132 |
| 4,715,296 | * | 12/1987 | Wilkinson | 108/116 |
| 4,864,941 | * | 9/1989 | Goulter | 108/132 |
| 4,949,649 | * | 8/1990 | Terres et al. | 108/116 |

FOREIGN PATENT DOCUMENTS

| | | | | |
|---|---|---|---|---|
| 250321 | * | 3/1964 | (AU) | 108/132 |

* cited by examiner

*Primary Examiner*—Jose V. Chen
(74) *Attorney, Agent, or Firm*—Robert K. Rhea

(57) ABSTRACT

A retrofit kit formed by pairs of telescoping legs and a tool anchoring platform for a collapsible leg structure for a metal bench including a T-shaped brace rod having one end of its stem pivotally connected to the underside of the bench and its other end extending between and lockingly engaged with the depending end portion of a pair of the legs. A strut, pivotally connected with the stem of the brace rod, is slidably engaged with a track bracket secured to the undersurface of the bench to limit downward movement of the brace rod with respect to the bench. Links connecting the legs to the strut collapse the legs to a folded position under the bench when the brace rod is manually released from the legs and moved toward the undersurface of the bench.

15 Claims, 9 Drawing Sheets

128
131
129
135
133

7
7
6
6
131
129
34
30
128
143
141
176
176
187
84
170
82
84
187
172

139
137
128

BENCH FOLDING LEG AND BRACE STRUCTURE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a metallic work bench folding leg and brace structure and more particularly to improved telescoping leg adjustment means and a tool mounting platform for such a bench structure.

1. Field of the Invention

2. Description of the Prior Art

The most pertinent patent is believed to be U.S. Pat. No. 4,191,111 issued Mar. 4, 1980 to me for Bench Folding Leg And Brace Structure. This patent discloses an elongated work bench normally supported by a downwardly diverging leg structure connected with a leg folding members. The leg folding members are pivotally connected with the undersurface of the work bench for pivoting the legs to a parallel stored position adjacent the undersurface of the work bench when not in use.

U.S. Pat. No. 3,469,870 issued Sep. 30, 1969 to Barcus for Telescopic Structure With Rotatable Shaft and U.S. Pat. No. 3,724,885 issued Apr. 3, 1973 to Becker for Locking Device For Extendible Tubes are believed good examples of the further state-of-the-art for telescoping tube or leg structure.

This invention is distinctive over the above named patents by providing improved telescoping retrofitting leg assemblies for increasing the operational height of the modified bench with the legs telescopically extended to a maximum height without increasing the bench minimum height with the legs telescopically collapsed. The present disclosure provides an improved leg fixed position adjustment means which is smoother operating, more positive, easier to manufacture and field replaceable. Also, this invention is distinctive over the above named patents by including a platform removably secured in overlying relation on the bench top surface for quickly mounting and supporting tools or equipment such as a power miter box saw, a table top, or the like.

BRIEF SUMMARY OF THE INVENTION

An elongated bench top of substantially channel shape in transverse section is provided adjacent its respective undersurface end portions with a leg bracket for pivotal connection with the upper end of a pair of legs in a manner permitting the legs to diverge downward, laterally and longitudinally of the bench when erected and to lie in parallel relation against the undersurface of the bench between the legs of the channel shape when folded. A T-shaped brace rod pivotally connected by its stem end to the undersurface of the bench has its bar end cooperating with lock pins to form a rigid connection with a depending end portion of the respective pair of legs when erected. A strut pivotally connected with the stem of the brace rod and slidably engaging a track bracket secured to the undersurface of the bench limits pivoting movement of the brace rod away from the bench. Leg folding links extending between and pivotally connecting the respective legs with the strut pivot the legs toward an erected or collapsed position by movement of the T bar end portion of the brace rod toward and away from the undersurface of the bench. Each leg is provided with a telescoping leg extension for elevating the bench. However, the leg length of the inner leg extension in the prior art bench is appreciably less than the length of the bench connected outer leg for the reason a lug on each leg adjacent its leg bracket connected end, is connected with a respective end of each of the folding links and extends through the wall of the outer leg and limits telescopic insertion of the inner leg extension into the outer or surrounding leg beyond the position of the lug. Accordingly, described is a retrofit package of an improved telescoping leg assembly which includes an inner extension leg of only nominally shorter length than the outer or surrounding leg and other improved operating features.

The principal object of this invention is to provide a retrofit package for an existing work bench which comprises pairs of extended range telescoping legs for disposing the bench top at a higher level, and providing a tool, equipment, or table supporting platform removably secured to the upper surface of the work bench by quick connect and release latches and to provide an improved means for adjusting the telescoping legs so that the bench top may be raised and lowered more easily.

DETAILED DESCRIPTION OF THE INVENTION

Figure 1:
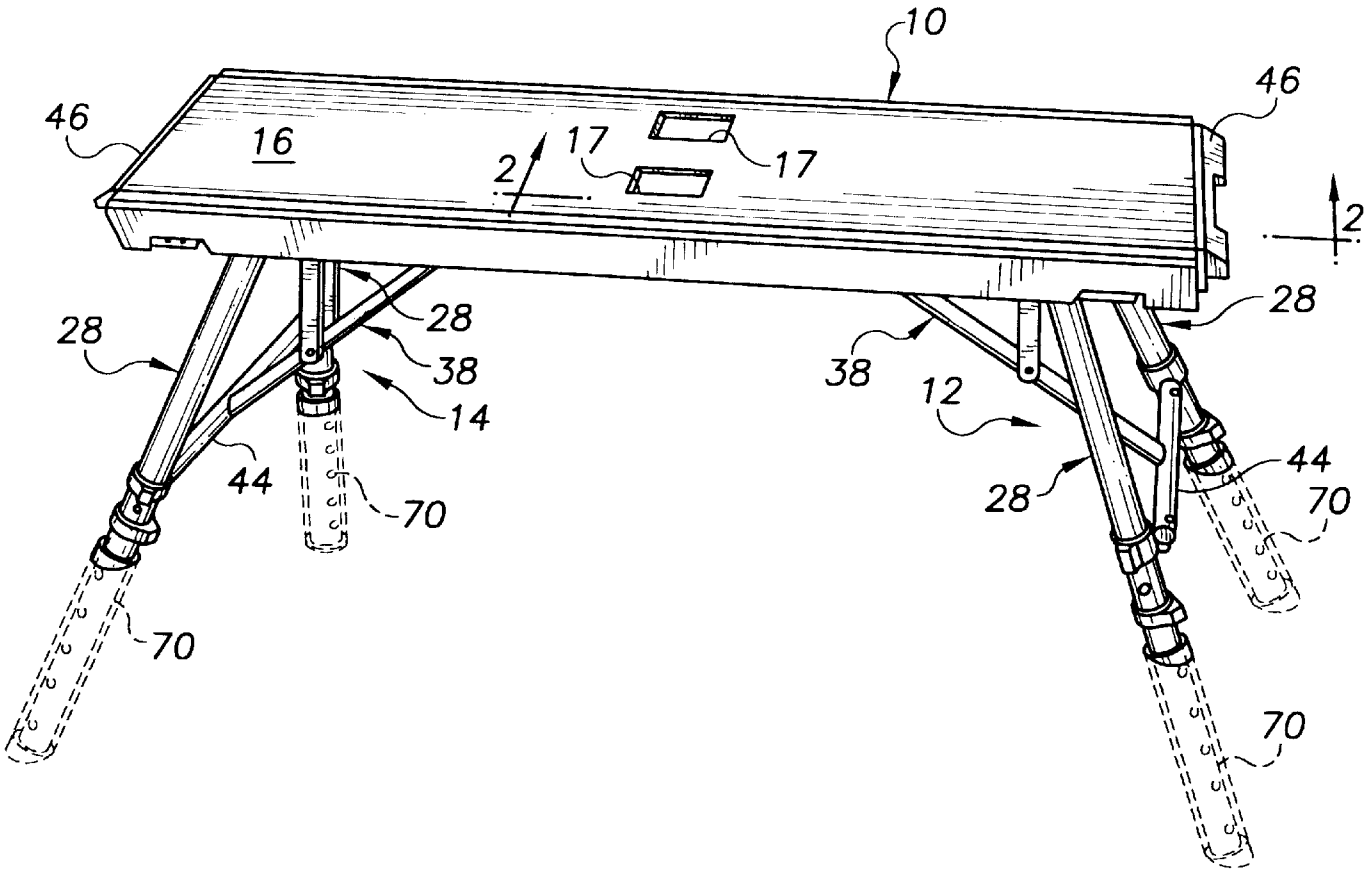
FIG. 1 PRIOR ART
FIG. 1 is a perspective view of a prior art bench in leg erected position, illustrating by dotted lines, the telescopic leg extensions in extended position.

Like characters of reference designate like parts in those figures of the drawings in which they occur.

Figure 2:
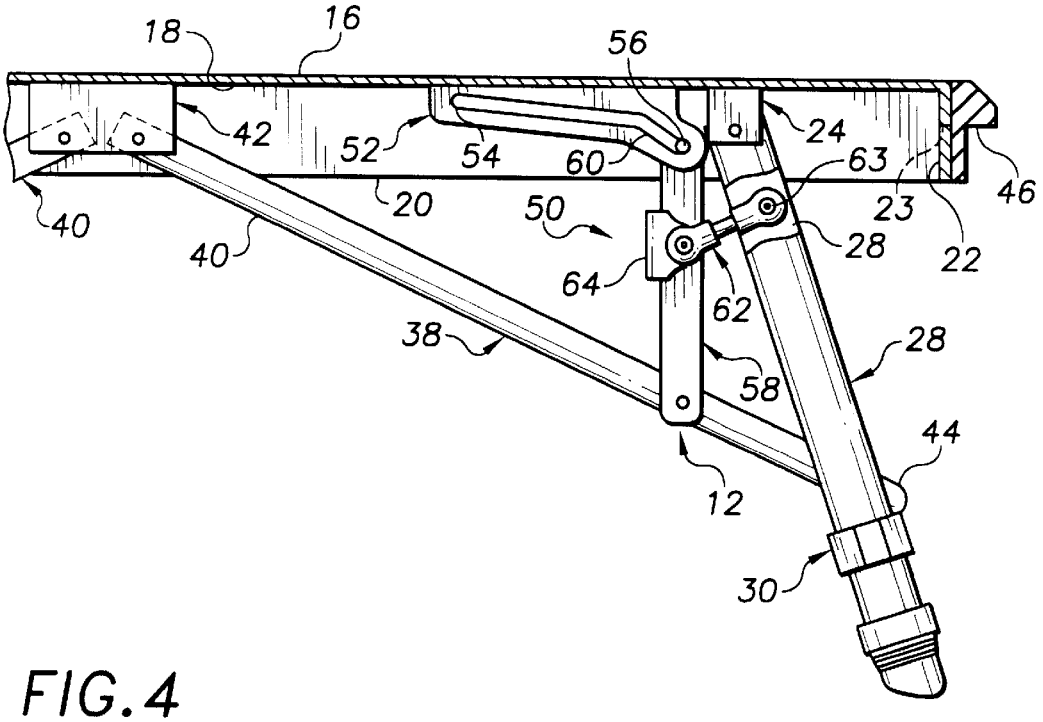
FIG. 2 PRIOR ART
FIG. 2 is a fragmentary vertical cross section of the prior art, to a larger scale, taken substantially along the line 2—2 of FIG. 1.
Figure 4:
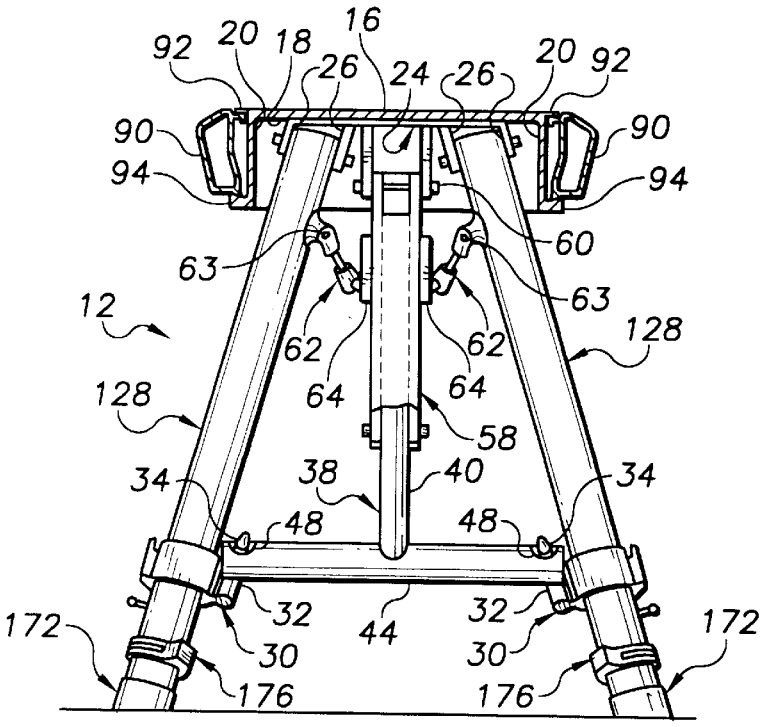
FIG. 4 is a vertical cross sectional view, to a larger scale partially in elevation, taken substantially along the line 4—4 of FIG. 3.

In the drawings:

Referring more particularly to FIGS. 1, 2 and 4, the reference numeral 10 indicates my prior art bench U.S. Pat. No. 4,191,111 incorporated herein by reference, as a whole, supported by a pair of folding leg and brace structures 12 and 14. The bench 10 is substantially channel-shaped in transverse section having a horizontal top 16 of uniform thickness having hand grip holes 17 medially its ends and defining a depending surface 18, parallel depending channel legs 20 and depending end walls 22. Each of the end walls 22 is provided with a downwardly open slot 23 for the purpose presently apparent.

The brace structures 12 and 14 are substantially identical and in the interest of brevity, only the brace structure 12 is described in detail.

A leg bracket 24 is transversely connected to the bench undersurface 18 adjacent one end portion of the bench. The leg bracket 24 is characterized by two spaced-apart pairs of clevis arms 26 projecting downwardly from the bench undersurface 18 in lateral diverging relation. A pair of tubular wall legs 28 are pivotally connected at their respective upper end portions between the respective pair of clevis arms 26 for pivoting movement toward and away from the bench undersurface 18. The pair of legs 28, when erected diverge downward, laterally and longitudinally with respect to the bench top. When folded against the bench undersurface 18, the legs lie in spaced-apart parallel relation. The depending end portion of each leg 28 is provided with a surrounding fixed position collar 30. Each of the collars 30 is characterized by a lateral extension 32 having a lock pin 34 secured thereto projecting generally toward the pivotally connected end of the respective leg.

Brace rod means 38, including a T-shaped brace rod, has one end portion of its stem 40 pivotally connected between the legs of a channel-shaped brace rod bracket 42 longitudinally secured to the bench undersurface 18 between the hand grip holes 17 with the brace rod cross bar 44 disposed transversely of the bench for vertical pivoting movement of the brace rod toward and away from the bench undersurface. The overall length of the brace rod, with respect to the bench, is such that its stem 40 is disposed between the pair of legs 28 and the cross bar 44 of the T-shape such that it will frictionally engage a brace rod latch element 46, preferably formed from resilient material, such as rubber, having a central downwardly open slot cooperatively aligned with the end wall slot 23 and coextensive with and secured to the outer surface of the respective bench end wall 22. The respective end portion of the cross bar 44 is provided with an aperture 48 for cooperative reception of the respective lock pin 34 thus locking the legs when in an erected position, as presently explained.

Link and track bracket means 50 interconnects the brace rod means 38 and legs 28 with the bench undersurface 18. The link and track bracket means 50 comprises an elongated track bracket 52 longitudinally secured to the bench undersurface 18 medially its width and between the leg bracket 24 and brace rod bracket 42. The track bracket 52 is channel-shaped in transverse section having the depending legs thereof cooperatively slotted transversely, intermediate their ends, as at 54. The slots 54 are inclined with respect to the bench undersurface 18 and terminate toward the leg bracket 24 in a horizontal plane forming an idler area 56 for the purposes presently explained.

A strut 58 is pivotally connected at one end with the brace rod stem 40 intermediate its ends and is slidably connected at its other end to the track bracket 52 by a pin 60 extending transversely of the track bracket and slidably supported at its end portions within the tracks formed by the bracket slots 54 so that when the legs and brace rod are moved downwardly toward an erected position, as viewed in FIG. 2, the end portions of the pin 60 are disposed in the slot idler area 56 thus stopping further downward movement of the brace rod with respect to the bench undersurface. The link means further includes a pair of links 62 which are pivotally connected at one end portion with the end portion of a screw 63 spaced downwardly and projecting inwardly of each leg 28 from its pivotal connection with the clevis bracket 24 and extending through the wall of the upper sleeve end portion of the respective outer bench leg 28 and pivotally connected at their other ends with suitable lug-like brackets 64 secured to opposing sides of the strut 58 intermediate its length. The inward end of the screws 63 thus limit the distance the inner extension legs 70 telescope into the outer legs 28 to that distance between the inward end of the respective screw 63 and the depending end of the respective outer leg 28.

The links 62 act to pivot the legs 28 downwardly from the bench undersurface 18 when the brace rod 40 is moved downwardly and to stop such leg movement when the pin 60 is disposed in the idler area 56 and the brace rod and legs are disposed in downwardly converging relation thus permitting the brace rod cross bar to be engaged with the collar pins 34. The pair of links 62, each comprise a turnbuckle for the purpose of adjusting its length in accordance with the desired spacing between its connection with the respective bench leg and the strut bracket 64. The pivotal connection 63, at the respective end of each link of the pair of links 62, is a ball joint type connector.

Figures 5, 6, 7:
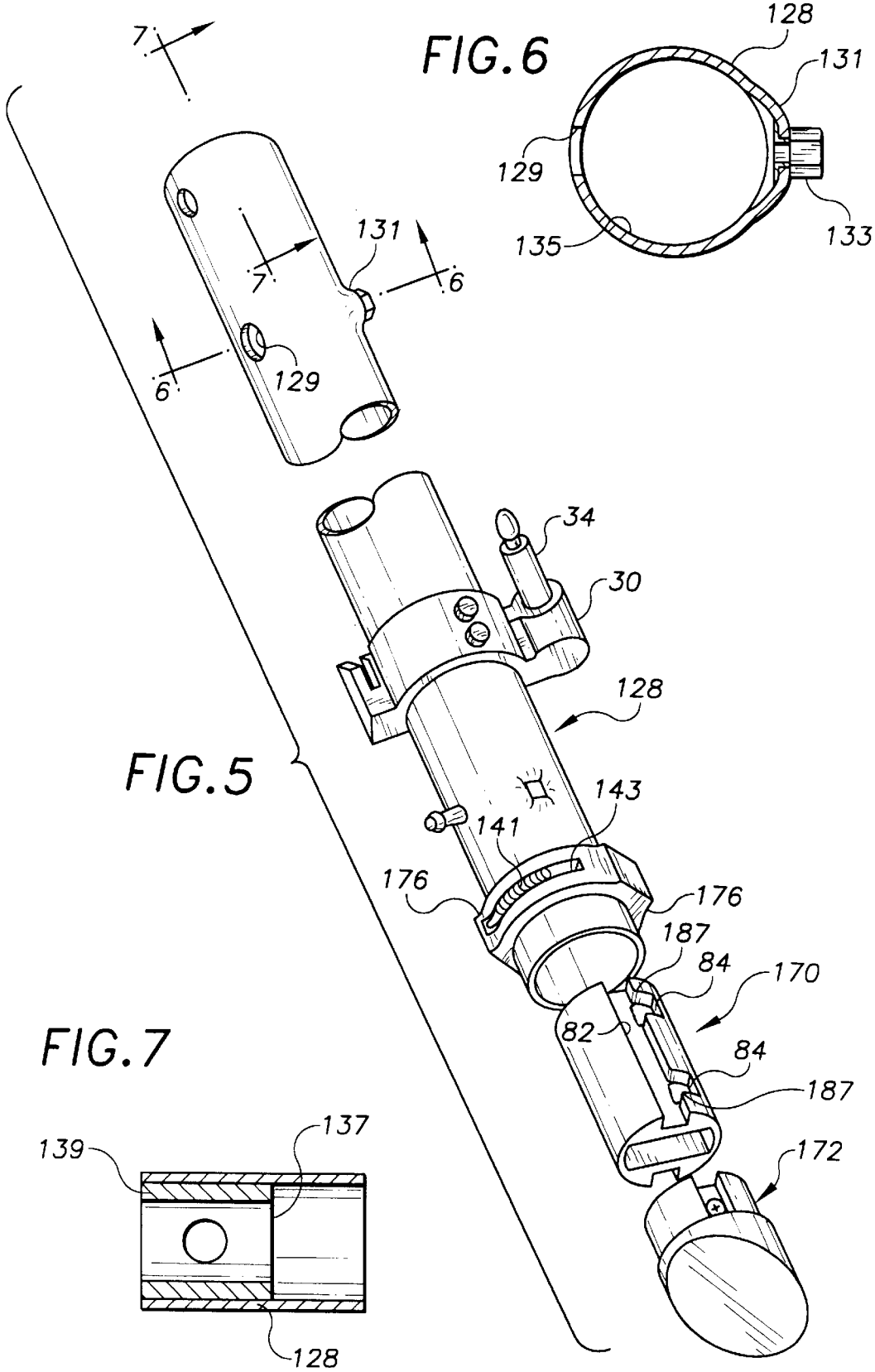
FIG. 5 is a fragmentary exploded perspective view, to a further enlarged scale, illustrating the improved telescopic extension leg assembly.
FIG. 6 is a transverse cross sectional view, to an enlarged scale, taken substantially along the line 6—6 of FIG. 5.
FIG. 7 is a longitudinal sectional view, to a different scale, taken substantially along the line 7—7 of FIG. 5.
Figure 8:
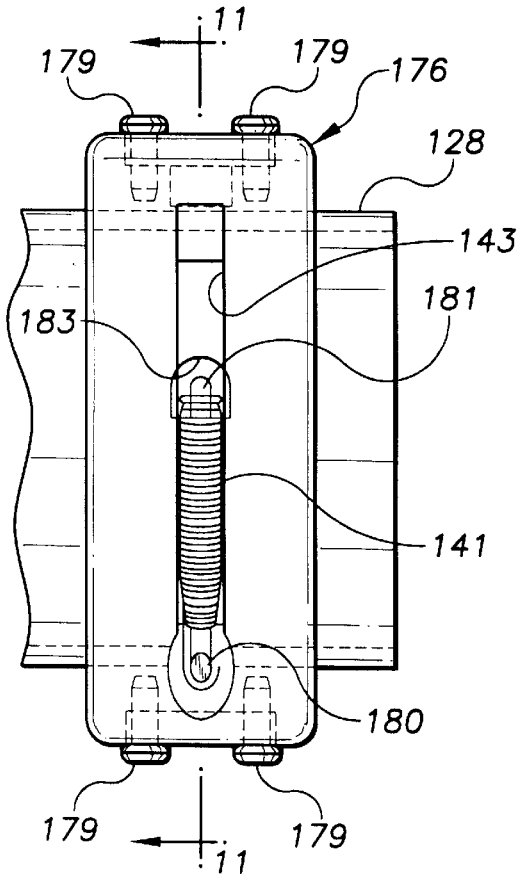
FIG. 8 is a fragmentary side elevational view, on an enlarged scale, of the improved leg lock collar on the depending end portion of the outer telescoping leg.
Figure 9:
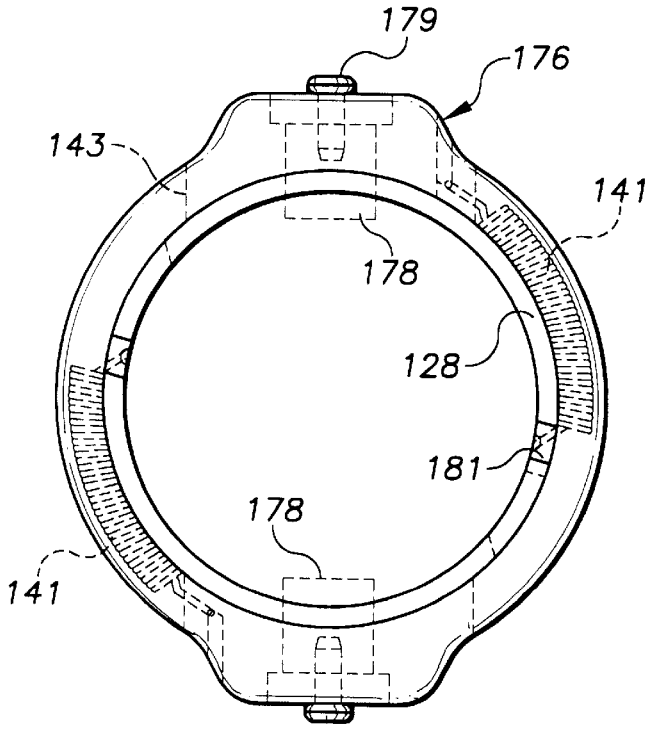
FIG. 9 is a right end elevational view of FIG. 8.

In accordance with the present invention and referring also to the remaining figures, an improved telescoping leg assembly (FIG. 5) including an outer leg 128 and an inner extension leg 170 having an overall length, including a foot portion 172, greater than the length of the prior art inner leg length as presently evident, and is configured as a complete leg assembly or package for retrofitting the prior art bench 10. The upper end portion of the outer leg 128 is pivotally connected with the prior art clevis arms 26. The wall of the outer leg 128, adjacent its clevis bracket connected end, is provided with a bore 129. The leg wall portion diametrically opposite the bore 129 is bulged or struck outward to form a protrusion 131 having a hexagonal nut 133 secured thereto (FIG. 6).

The inner wall surface 135 of the outer leg 128 permits the inward end of the telescoping leg 170 to slidably extend into the leg 128 until the inner end of the leg 170 abuts the inward end surface 137 of the outer leg wall reinforcing sleeve 139.

Figure 10:
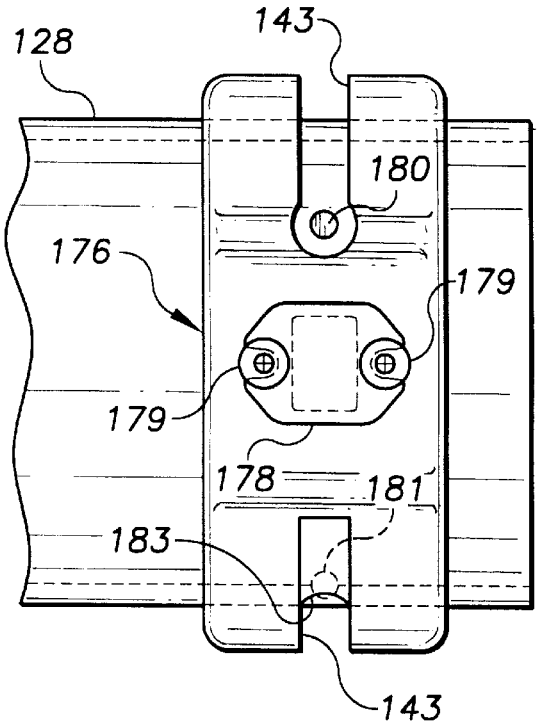
FIG. 10 is a top view of FIG. 8.
Figure 11:
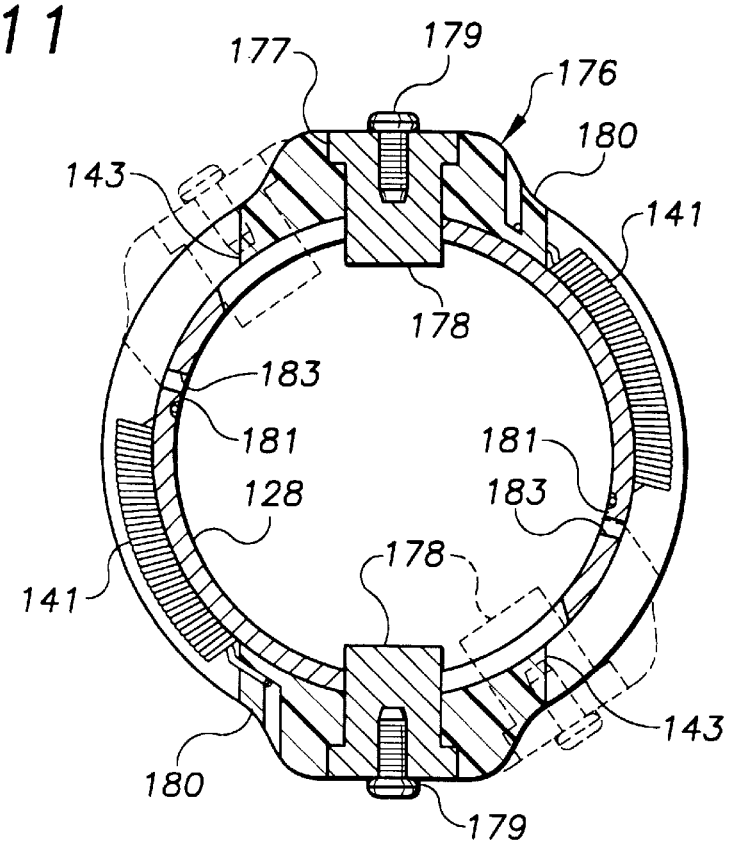
FIG. 11 is a vertical cross sectional view taken substantially along the line 11—11 of FIG. 8 and illustrating by dotted lines the relative position of the inner telescoping leg.

The prior art leg extension lock collar 76 is retrofitted by an in the field replaceable lock collar 176 formed in endless ring fashion from non-metallic material providing a non-galling low friction bearing surface for ease of angular rotation relative to the leg 128. The lock collar 176 similarly includes diametrically opposite field replaceable inwardly projecting inner leg locking lugs 178 similar to prior art lugs, not shown, in the lock collar 30 which required press fitting in the prior art lock collar. The lugs 178 include a flange end 177 and are secured in the collar 176 by means of an overlying recessed plate and screws 179 (FIG. 10). The lugs 78 are longitudinally slidable in the extension leg longitudinal grooves 82 (FIG. 5) and freely enter one of a series of longitudinally spaced slots 84 extending latterly from one side of the groove 82 to lock the inner leg 170 with the outer leg. The slots 84 are characterized at their juncture with the groove by a lead-in radii on opposite corner edges, as at 187, for preventing generating burrs on these edges and to insure ease of entry of the lugs 178. A pair of springs 141 nested by grooves 143 in diametric opposite areas of the lock collar 176 are respectively connected at one end by an end tang with an integral lock collar pin 180 and at the other end with a leg wall tongue 181 fabricated in the wall of leg 128 within a partially surrounding recess 183 for loosely receiving the spring other end tang without the spring tang protruding into the inner space of the leg 128 and interfering with the installation or rotation of the lock collar 176. The springs 141 normally bias the lugs 178 into selected extension leg lateral slots 84, as presently explained.

Referring more particularly to FIGS. 12 and 17–19, the step forming bench top side rails 90 are normally held in place by the top and bottom lip elements 92 and 94 of the bench top side rails 20. The bench top supporting of the side rails 90 is enhanced by a spring clip 200. One end portion of the spring clip 200 is attached to the side rail 90 medially its end and the other end portion 201 of the spring clip is interposed between the depending surface of the side rail and the lip 94 of the bench side rail 20 in a partial wrap around action of the lower portion of the respective side rail 90 to insure retaining the side rail on the bench top.

The respective hollow end portion of the side rail 90 is preferably closed by an end cap 202. The end cap is preferably formed from resilient material and is characterized by a planar end wall 204 having a perimeter complimentary with the perimeter of the respective end of the side rail 90. The end cap further includes an endless side wall 206 which is frictionally received by the inner peripheral wall surface 208 of the side rail 90. The end cap is further characterized by a plurality of transverse partition walls 210 to maintain the endless wall configuration of the end cap and insure its retention by the respective end portion of the side rails 90.

Figure 14:
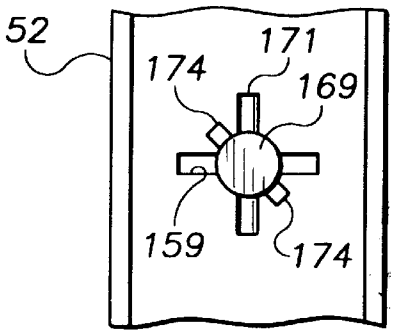
FIG. 14 is a fragmentary elevational view looking in the direction of the arrows 14—14 of FIG. 13.

The bench retrofit package further includes a support panel 147 (FIG. 3) for mounting a tool such as a miter saw, not shown, on the bench top 116. The panel 147 may be singular or multiple hingedly joined sections, as illustrated by broken lines (FIG. 3), and generally rectangular in overall configuration and disposed longitudinally on the bench top 116. Respective end portions of the support panel 147 are bored, as at 151 (FIGS. 12–13), in vertical alignment with cooperating apertures 153 punched through the work bench top. The apertures 153 are characterized by lateral diametrically opposite slots 159. In the example shown, the bench top apertures 153 are also punched through the prior art track bracket 52 (FIGS. 13–14), between the legs thereof, and form diametrically opposite depending stops 174 (FIG. 14), for the purpose presently explained. The panel apertures 151 respectively receive quick connect and release latch means 155 for removably joining the panel 147 to the bench 116.

Figure 3:
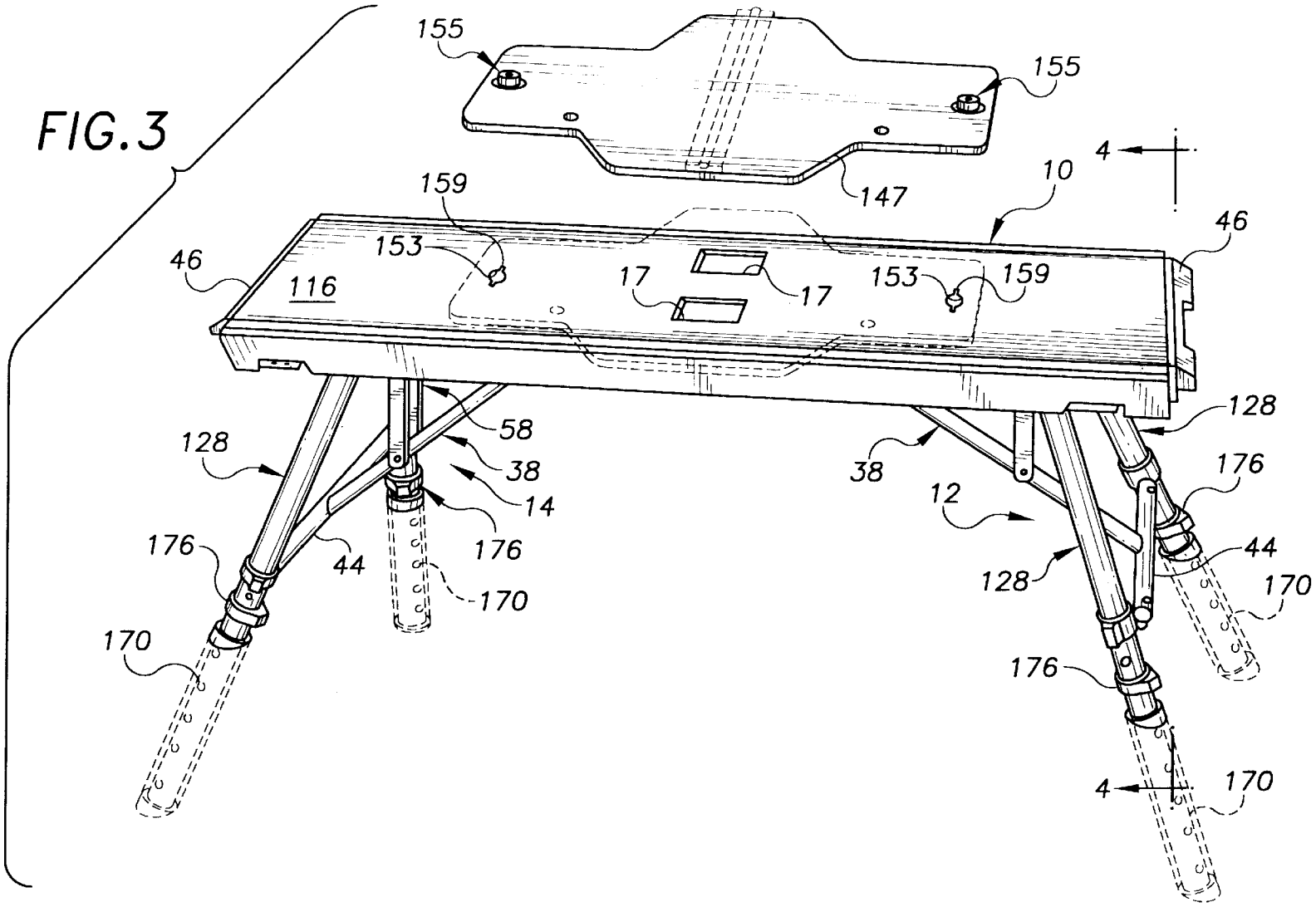
FIG. 3 is a similar perspective view of the work bench having the improved legs and illustrating, in exploded relation, a tool mounting platform.
Figure 12:
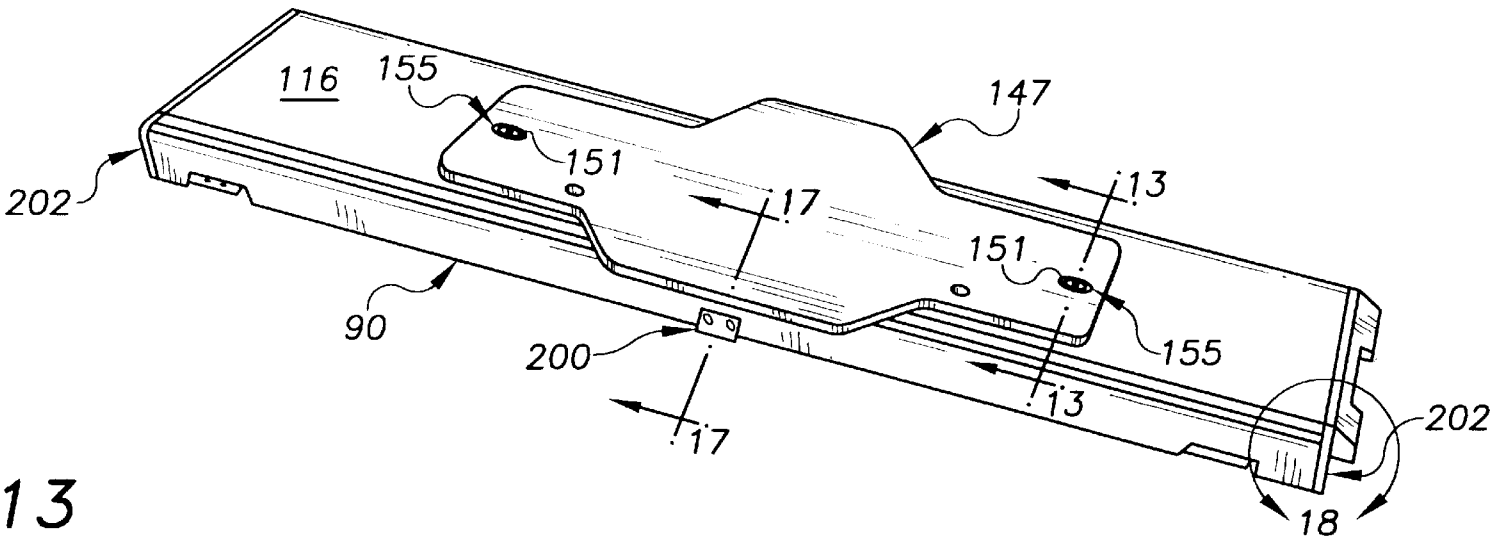
FIG. 12 is a perspective view of the bench top of FIG. 3 with the legs removed, illustrating the tool platform sell cured thereto.
Figure 13:
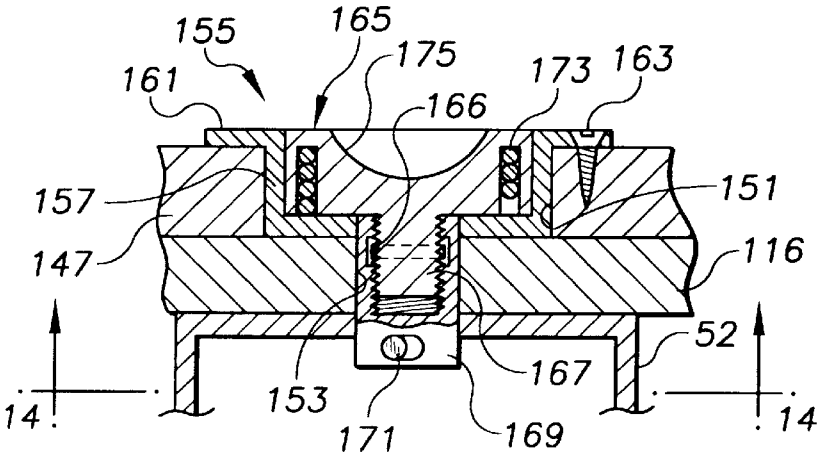
FIG. 13 is a fragmentary vertical cross sectional view, to a different scale, taken substantially along the line 13—13 of FIG. 12.

Referring more particularly to FIGS. 3, 12 and 13, the quick connect and release latch means 155 comprises a cup-like socket 157 having a cylindrical wall portion snugly received by the wall forming the panel aperture 151 and having a centrally bored bottom wall. An outstanding peripheral flange 161 on the cup socket wall overlies the top surface of the panel 147 for securing the socket 157, as by screws 163, only one being shown. A cylindrical latch body 165 is angularly rotatably received by the cup socket 157 and includes a threaded stem 167, having a thread frictional locking element 166, secured to a latch shaft 169 in turn slidable and angularly rotatably received by the bench top bore 153. The inward end of the latch body 165 is provided with a downwardly open annular slot adjacent its periphery which receives a compression spring 173 normally biasing the latch body 165 out of the cup socket 157. The shaft 169 transversely supports, at its depending end portion, a lock pin 171 which cooperatively enters the diametrically opposite slots 159 of the bench top bore 153 for contiguously locking the panel 147 to the bench top when the spring 173 is manually compressed into the cup 157. The shaft 169 and lock pin 171 are angularly frictionally rotated substantially 95° in one direction, by the latch body 165, from the position of the opposing slots 159 of the bore 153. Respective end portions of the lock pin 171 contact the stops 174 for indicating a latch locked position. The latch body 165 is further provided with an arcuate relatively narrow inwardly extending groove 175 which receives a key, for example, a chord of a coin, or the like, for manually collapsing the spring 173 by depressing the latch body and angularly rotating the same and the lock pin 171 in a latch locking or releasing direction.

Figure 16:
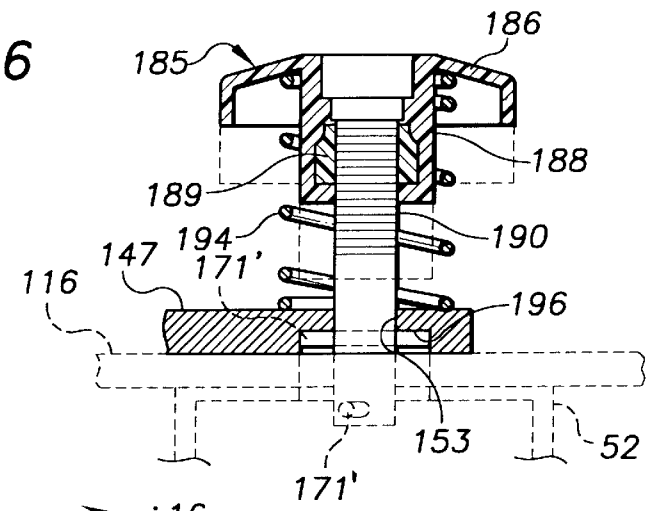
FIG. 16 is a fragmentary vertical cross sectional view, to larger scale, taken substantially along the line 16—16 of FIG. 15.
Figure 15:
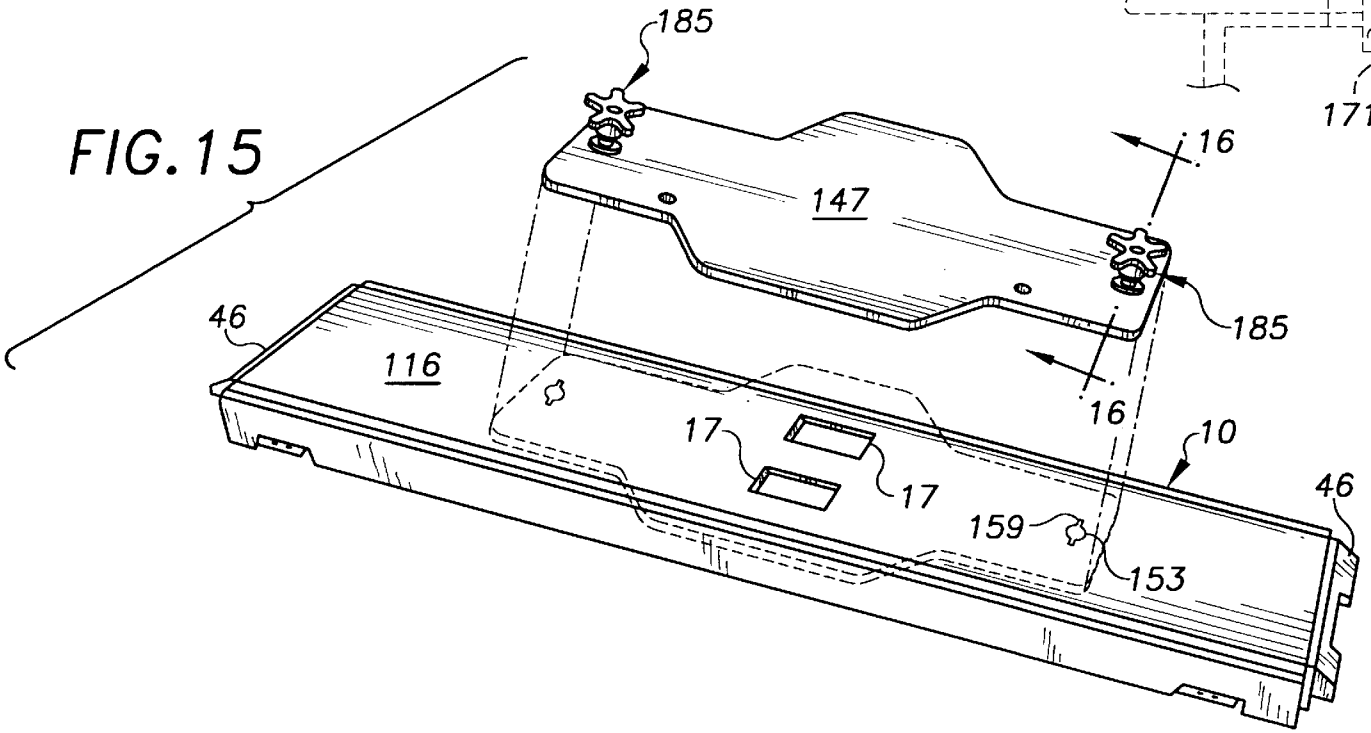
FIG. 15 is a bench top view similar to FIG. 3, with the legs removed, illustrating another embodiment of a quick connect and release latch.
Figure 17:
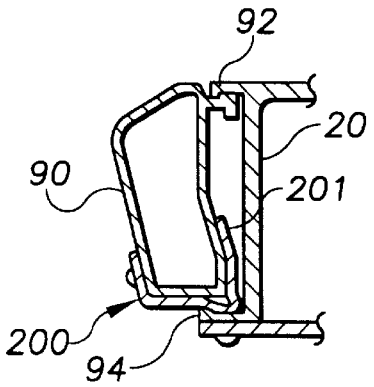
FIG. 17 is a vertical cross section taken substantially along the lines 17—17 of FIG. 12.
Figure 18:
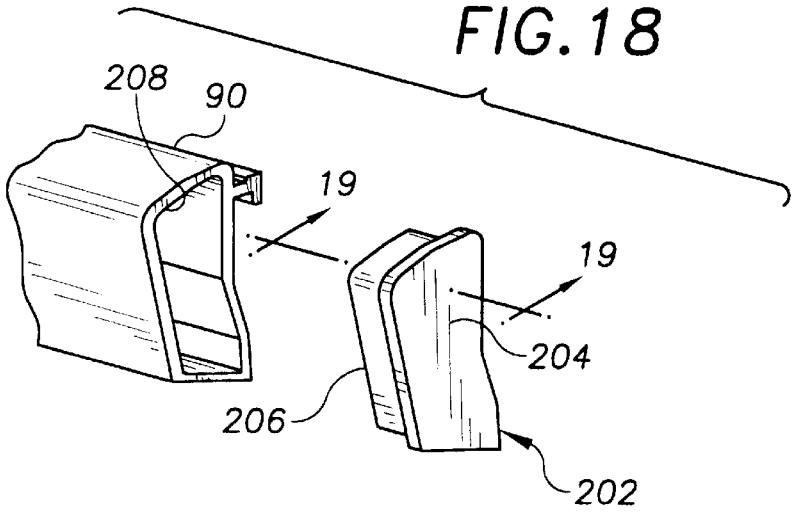
FIG. 18 is an exploded isometric view of the area enclosed by the arrows 18 of FIG. 12; and, FIG. 19 is a vertical cross section, to a larger scale taken substantially along the line 19—19 of FIG. 18.
Figure 19:
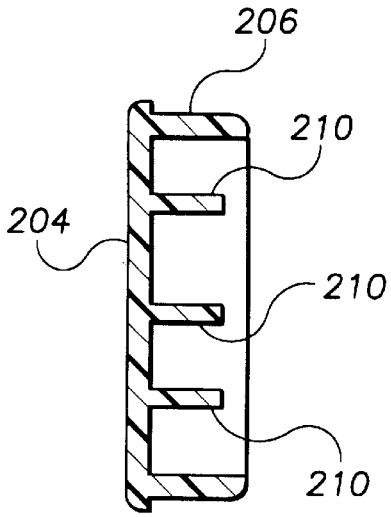

Referring also to FIGS. 15 and 16, an alternative quick connect and release latch means 185 secures the panel 147 to the bench top 116 and comprises a cup-like star shaped, in the example shown, control wheel 186 having a central downwardly directed centrally bored and threaded sleeve 188, similarly provided with a thread friction locking element 189, secured and frictionally held to one end portion of a latch shaft 190 vertically slideably received by the bore 153 in the respective end portion of the panel 147. The depending end portion of the shaft 190 is similarly provided with a transversely disposed latch pin 171' which similarly enters the slots 159 of the bench top bores 153 to secure the panel 147 to the bench top 116 when the latch shaft 190 is inserted into bench top bore 153 and angularly rotated substantially 95°, in one direction (preferably a thread engaging direction) after insertion until it stops when latch pin 171' contacts the bracket stops 174. When not engaged with the bench top 116 the latch pin 171' is normally nested by a slot 196 in the depending surface of the respective end portion of the panel 147. Resilient means such as a helical expansion spring 194 axially surrounds the star wheel sleeve 188 and is interposed between the depending surface of the control wheel and the adjacent surface of the panel 147 to bias the latch pin 171' against the depending surface of the bench top 116 when the latch means 185 is in connected position with respect to the bench top which is accomplished by manually depressing the control wheel 186 and spring 194 to similarly engage the stops 174. With the latch pin 171' in contact with the stops 174, the control wheel 186 may be manually further threadedly engaged with the shaft 190 until the spring 194 is substantially collapsed and the depending end of the sleeve 188 contacts the surface of the panel 147, thus immobilizing the spring release feature of the latch means 185.

Obviously the invention is susceptible to changes or alterations without defeating its practicability. Therefore, I do not wish to be confined to the preferred embodiments shown in the drawings and described herein.

I claim:

1. In combination with a metal bench having opposing ends, an undersurface, bench leg bracket means secured to the undersurface of each end portion of said bench top, a bench brace rod at respective end portions of the bench undersurface and having opposing end portions projecting longitudinally of the bench medially the bench width and having one end portion of each rod pivotally connected with a medial portion of the undersurface for vertical pivoting movement of each rod other end portion toward and away from said undersurface, said other end portion of said brace rod having a transverse cross bar provided with a lock pin receiving aperture at respective ends of the cross bar, said metal bench comprising:

pairs of inner and outer telescoping tubular wall bench legs having upper and lower end portions pivotally connected by the respective upper end portion of each outer bench leg of said pairs of bench legs to said bench leg bracket means on transversely aligned inclined axes for disposing the longitudinal axes of each pair of said pairs of telescoping bench legs when erected in downward lateral and longitudinal diverging relation relative to said bench top, the tubular wall of each outer leg of each pair of said pairs of legs having a connector supporting protrusion adjacent said pivotally connected upper end portion permitting unobstructed inward telescopic movement of the upper end portion of the respective inner leg beyond the position of the wall protrusion, each inner leg of each pair of said pairs of bench legs having a foot forming extension axially depending from its lower end portion; and, link and track bracket means pivotally connecting an intermediate portion of each said brace rod with said wall protrusion on the respective outer leg of each pair of said pairs of bench legs for pivoting movement of said pairs of bench legs from a bench erected position to a parallel stored position adjacent said undersurface and vice versa by vertical movement of said bench brace rod.

2. The combination according to claim 1 and further including:

a nut secured to the wall protrusion for connection with said link means of said link and track bracket means.

3. The combination according to claim 2 in which said each said inner leg is coextensively provided with diametrically opposite groves, each groove having diametrically opposite series of longitudinally spaced inner leg slots projecting laterally from one side of each groove, and further including:

each said outer leg of said pairs of legs having diametrically opposite slots in its end portion adjacent said foot; and, field replaceable inner leg locking collar means rotatably surrounding each said outer leg in overlying relation with respect to the outer leg diametrically opposite slots.

4. The combination according to claim 3 in which the edges of the inner leg lateral slots at the juncture with the inner leg groove are provided with a radius for ease of accepting the collar locking lugs.

5. The combination according to claim 3 in which the locking collar means includes:

a collar having diametrically opposite circumferentially extending through slots;

a pair of diametrically opposite inner leg locking lugs projecting through said collar for normally maintaining the respective pair of legs in a selected telescopic position; and, resilient means longitudinally disposed, within the respective collar slot and connected at respective ends with the collar and the outer leg for normally biasing said collar locking lugs in an inner leg locking lug slot entering direction.

6. The combination according to claim 5 in which the sides of said bench top are channel shaped having upper and lower horizontal parallel channel legs supporting a bench step side rail, and further including:

an elongated spring clip means secured by one end portion to said side rail and interposed at its other end portion between said side rail and the lowermost said channel leg.

7. The combination according to claim 6 in which the bench step further includes:

a resilient end cap on the respective end of said bench side rail.

8. The combination according to claim 5 in which said bench top is provided with longitudinally spaced through apertures, and further including;

a tool supporting panel longitudinally overlying said bench top and having through apertures in registration with the bench top apertures; and, quick connect and release latch means for anchoring said panel on said bench top.

9. The combination according to claim 8 in which the latch means includes:

a shaft rotatably projecting through the panel and bench top apertures;

a latch pin transversely extending through the shaft adjacent the bench undersurface;

a shaft control member threadedly and frictionally secured to the other end portion of said shaft;

a latch pin stop secured to the bench top undersurface for limiting angular rotation of the shaft; and, a resilient member biasing said latch pin toward the undersurface of said bench top.

10. The combination according to claim 9 in which the latch means includes:

a cylindrical wall having a centrally apertured end wall for forming a socket axially nested by each panel aperture;

a latch body having an axial stem angularly rotatable in the socket;

an internally threaded sleeve having one end threadedly and frictionally secured to the latch body stem and projecting through the bench top aperture;

a second latch pin extending through the other end portion of the sleeve; and, a resilient member axially biasing the second latch pin toward the undersurface of the socket.

11. The combination according to claim 1 in which opposite sides of the bench top removably support a bench step between upper and lower bench top channel legs and further including;

a spring clip having a first end portion secured to said bench step intermediate its ends, said clip having a second end portion normally interposed between the bench step and one said channel leg.

12. A work bench having a bench top provided with longitudinally spaced through apertures, comprising;

a tool supporting panel longitudinally overlying said bench top and having through apertures in registration with the bench top apertures;

quick connect and release latch means for anchoring said panel on said bench tops said latch means including a shaft rotatably projecting through the panel and bench top apertures; and, a latch Pin transversely extending through the shaft adjacent the bench undersurface.

13. A work bench having a bench top provided with longitudinally spaced through apertures, comprising:

a tool supporting panel longitudinally overlying said bench top and having through apertures in registration with the bench top apertures:

quick connect and release latch means for anchoring said panel on said bench top, said latch means including:

a shaft rotatably projecting through the panel and bench top apertures;

a latch pin transversely extending through the shaft adjacent the bench undersurface;

a shaft control member threadedly and frictionally secured to the other end portion of said shaft;

a latch pin stop secured to the bench top undersurface for limiting angular rotation of the shaft; and, a resilient member biasing said latch pin toward the under-surface of said bench top.

14. The combination according to claim 13 in which the latch means includes:

a cylindrical wall having a centrally apertured end wall for forming a socket axially nested by each panel aperture;

a latch body having an axial stem angularly rotatable in the socket;

an internally threaded sleeve having one end threadedly and frictionally secured to the latch body stem and projecting through the bench top aperture;

a second latch pin extending through the other end portion of the sleeve; and, a resilient member axially biasing the second latch pin toward the undersurface of the socket.

15. The combination according to claim 13 in which the panel is transversely divided defining panel end portions and further including:

a hinge joining the panel end portions; and, latch means for anchoring said platform to the bench top.

* * * * *